US006965276B2

(12) United States Patent
Hasegawa

(10) Patent No.: US 6,965,276 B2
(45) Date of Patent: Nov. 15, 2005

(54) TWO PORT TYPE ISOLATOR AND COMMUNICATION DEVICE

(75) Inventor: Takashi Hasegawa, Mattou (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 89 days.

(21) Appl. No.: 10/607,262

(22) Filed: Jun. 27, 2003

(65) Prior Publication Data

US 2004/0004521 A1 Jan. 8, 2004

(30) Foreign Application Priority Data

Jul. 4, 2002 (JP) ..... 2002-196439

(51) Int. Cl.[7] ..... H01P 1/36
(52) U.S. Cl. ..... 333/24.2; 333/1.1
(58) Field of Search ..... 333/1.1, 24.2

(56) References Cited

U.S. PATENT DOCUMENTS

2002/0171504 A1 * 11/2002 Takeda et al. ..... 333/24.2
2004/0004521 A1 * 1/2004 Hasegawa ..... 333/24.2
2004/0207479 A1 * 10/2004 Hasegawa ..... 333/24.2

FOREIGN PATENT DOCUMENTS

| | | |
|---|---|---|
| JP | 09-232818 | 9/1997 |
| JP | 11-308013 | 11/1999 |
| JP | 2000-114818 | 4/2000 |
| JP | 2001-185912 | 7/2001 |
| JP | 2001-237613 | 8/2001 |
| JP | 2001-320205 | 11/2001 |
| JP | 2001-320206 | 11/2001 |
| JP | 2004-193904 | * 7/2004 |

* cited by examiner

*Primary Examiner*—Vibol Tan
(74) *Attorney, Agent, or Firm*—Keating & Bennett, LLP

(57) ABSTRACT

A two-port isolator capable of suppressing propagation of the second harmonic wave (2*f*) or the third harmonic wave (3*f*) of the used frequency f includes a parallel RC circuit, which includes a first matching capacitor and a resistor, and the parallel RC circuit is electrically connected between an input port P1 and an output port P2. A series resonant circuit including a second matching capacitor and an inductor is electrically connected between the output port P2 and ground. The resonant frequency of the series resonant circuit is set between the frequencies of the second and third harmonic waves.

21 Claims, 21 Drawing Sheets

TWO PORT TYPE ISOLATOR AND COMMUNICATION DEVICE

BACKGROUND OF THE INVENTION

1. Field of the Invention

The present invention relates to a two-port isolator and, more particularly, to a two-port isolator for use in, for example, a microwave band, and also relates to a communication device provided with the two-port isolator.

2. Description of the Related Art

Generally, isolators pass signals only in the transmission direction and suppress signals in the opposite direction. Such isolators are used in transmitting circuits in mobile communication devices such as car phones and mobile phones.

Three-port isolators (isolators having first through third center electrodes) are taught in Japanese Unexamined Patent Application Publication Nos. 2001-320205, 2001-320206, 11-308013, and 2000-114818. Also, two-port isolators (isolators having first and second center electrodes) are taught in Japanese Unexamined Patent Application Publication Nos. 2001-237613 and 2001-185912.

Three-port isolators and two-port isolators propagate signals from an input port P1 to an output port P2 by magnetic coupling, and thus undesirably have a large coupling loss between the input port P1 and the output port P2.

In order to solve this problem, a low-loss two-port isolator is taught in Japanese Unexamined Patent Application Publication No. 9-232818. FIG. 21 is an equivalent circuit diagram of this conventional two-port isolator. One end 321*a* of the first center electrode 321 is electrically connected to the input outer electrode 314 through the input port P1. The other end 321*b* of the first center electrode 321 is electrically connected to the output outer electrode 315 through the output port P2. Directly connecting the input port P1 to the output port P2 through the first center electrode 321 decreases the coupling loss between the input port P1 and the output port P2.

One end 322*a* of the second center electrode 322 is electrically connected to the output outer electrode 315 through the output port P2. The other end 322*b* of the second center electrode 322 is electrically connected to the ground electrode 316 through the third port P3. A parallel RC circuit including a matching capacitor 325 and a resistor 327 is electrically connected between the input port P1 and the output port P2. A matching capacitor 326 is electrically connected between the output port P2 and another ground electrode 316. The ground electrodes 316 are electrically grounded.

The input port P1 is directly connected to the output port P2 through the first center electrode 321 in the known two-port isolator 301, thus disadvantageously propagating the second harmonic wave (2*f*) or the third harmonic wave (3*f*) of the frequency f used in the mobile communication device.

SUMMARY OF THE INVENTION

In order to overcome the problems described above, preferred embodiments of the present invention provide a two-port isolator capable of suppressing the propagation of the second harmonic wave (2*f*) or the third harmonic wave (3*f*) of the used frequency f and provides a communication device including such a novel two-port isolator.

A two-port isolator according to a first preferred embodiment of the present invention includes a permanent magnet, a ferrite to which a DC magnetic field is applied by the permanent magnet, a first center electrode that is placed on the surface of the ferrite or inside the ferrite, one end of the first center electrode being electrically connected to a first input-output port and the other end of the first center electrode being electrically connected to a second input-output port, a second center electrode that is placed on the surface of the ferrite or inside the ferrite while intersecting with the first center electrode in an electrically insulated state, one end of the second center electrode being electrically connected to the second input-output port and the other end of the second center electrode is electrically grounded, a first matching capacitor that is electrically connected between the first input-output port and the second input-output port, a resistor that is electrically connected between the first input-output port and the second input-output port, and a series resonant circuit, including a second matching capacitor and an inductor, electrically connected between the second input-output port and the ground.

The resonant frequency of the series resonant circuit including the second matching capacitor and the inductor is preferably located between the frequencies of the second and third harmonic waves.

A two-port isolator according to a second preferred embodiment of the present invention includes a permanent magnet, a ferrite to which a DC magnetic field is applied by the permanent magnet, a first center electrode that is placed on the surface of the ferrite or inside the ferrite, one end of the first center electrode being electrically connected to a first input-output port and the other end of the first center electrode being electrically connected to a second input-output port, a second center electrode that is placed on the surface of the ferrite or inside the ferrite while intersecting with the first center electrode in an electrically insulated state, one end of the second center electrode being electrically connected to the second input-output port and the other end of the second center electrode being electrically connected to a third port, a first matching capacitor that is electrically connected between the first input-output port and the second input-output port, a resistor that is electrically connected between the first input-output port and the second input-output port, a second matching capacitor that is electrically connected between the second input-output port and the third port, and an inductor that is electrically connected between the third port and the ground.

The resonant frequency of a circuit that includes a parallel resonant circuit, including the inductance of the second center electrode and the second matching capacitor, and the inductor is preferably between the frequencies of the second and third harmonic waves.

With the structures described above, the second harmonic wave (2*f*) or the third harmonic wave (3*f*) that is propagated through the first center electrode can be attenuated, where f denotes the frequency used.

In a two-port isolator according to the first and second preferred embodiments of the present invention, the respective capacitor electrodes of the first matching capacitor and the second matching capacitor and the inductor electrode of the inductor are preferably provided on a multilayer substrate of insulating layers. With such a structure, the number of points where the first matching capacitors, the second matching capacitor, and the inductor are fixed to each other with solder can be reduced, thus achieving an isolator having higher connection reliability.

A communication device according to the first and second preferred embodiments of the present invention is provided with one of the two-port isolators described above, thus improving the frequency characteristics.

Other features, elements, characteristics and advantages of the present invention will become more apparent from the following detailed description of preferred embodiments thereof with reference to the attached drawings.

DETAILED DESCRIPTION OF PREFERRED EMBODIMENTS

Two-port isolators and a communication device according to preferred embodiments of the present invention will be described below with reference to the attached drawings.

Figure 1:
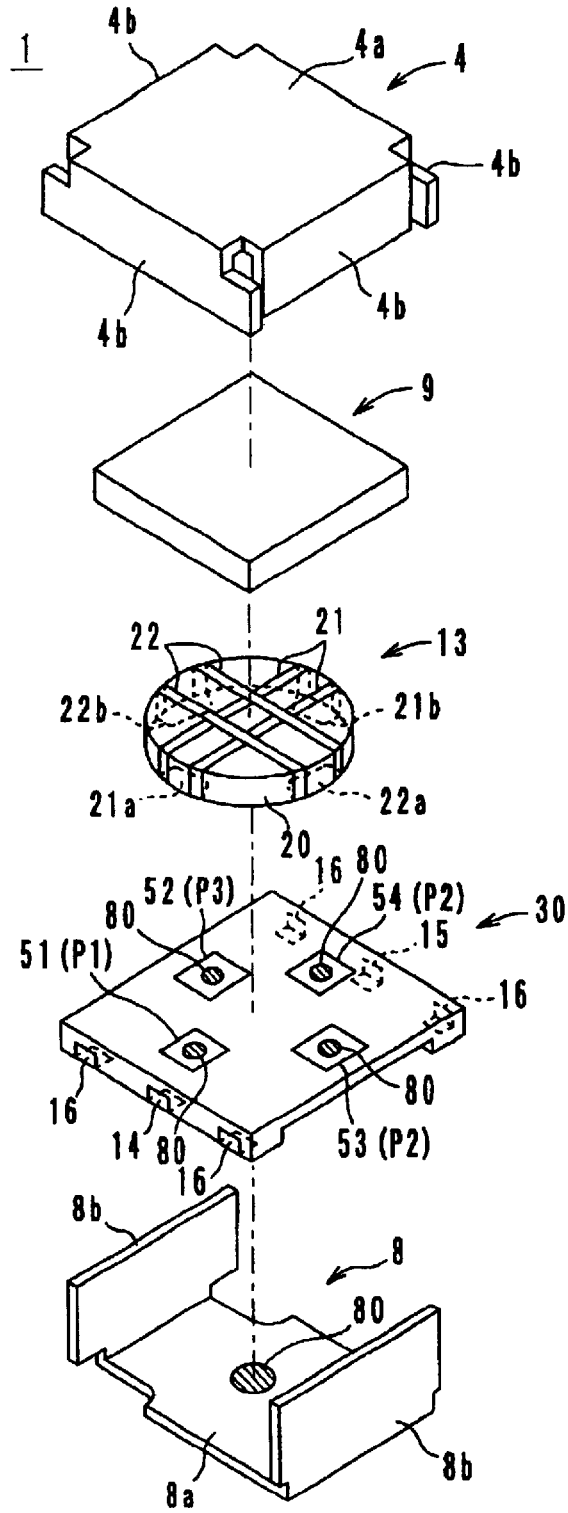
FIG. 1 is an exploded perspective view of a two-port isolator according to the first preferred embodiment of the present invention.

FIG. 1 is an exploded perspective view of a two-port isolator according to the first preferred embodiment of the present invention. The two-port isolator 1 in FIG. 1 is preferably a lumped-constant isolator. Referring to FIG. 1, the two-port isolator 1 includes a metallic case including a metallic top case 4 and a metallic bottom case 8, a permanent magnet 9, a center electrode assembly 13 including a ferrite 20 and center electrodes 21 and 22, and a multilayer substrate 30.

The metallic top case 4, which substantially has the shape of a box, includes a top surface 4*a* and four side surfaces 4*b*. The metallic bottom case 8 includes a bottom surface 8*a* and right and left side surfaces 8*b*. The metallic top case 4 and the metallic bottom case 8 are preferably formed of a ferromagnetic material such as soft iron for forming a magnetic circuit. The surfaces of the metallic top case 4 and the metallic bottom case 8 are preferably plated with Ag or Cu.

The center electrode assembly 13 includes the substantially circular ferrite 20 and two pairs of center electrodes. That is, the center electrode assembly 13 includes the first center electrode 21 and the second center electrodes 22 disposed on the ferrite 20. The first center electrode 21 and the second center electrode 22 intersect with each other at right angles with insulating layers (not shown) sandwiched therebetween. According to the first preferred embodiment, the first center electrode 21 and the second center electrode 22 each have two lines. Both ends 21*a* and 21*b* of the first center electrode 21 and both ends 22*a* and 22*b* of the second center electrode 22 extend beneath the ferrite 20. The ends 21*a*, 21*b*, 22*a*, and 22*b* are separated from each other.

The first center electrode 21 and the second center electrode 22 are made of copper foil. The first center electrode 21 and the second center electrode 22 may be wound around the ferrite 20 or may be printed on or inside the ferrite 20 with silver paste. Alternatively, the first center electrode 21 and the second center electrode 22 may be disposed in a multilayer substrate as taught in Japanese Unexamined Patent Application Publication No. 9-232818. The first center electrode 21 and the second center electrode 22 that are printed on or inside the ferrite 20 have higher position accuracy and, therefore, are more stably fixed to the multilayer substrate 30 compared with the remaining cases. In particular, when the first center electrode 21 and the second center electrode 22 are fixed to the multilayer substrate 30 with connection electrodes 51 to 54, the first center electrode 21 and the second center electrode 22 have higher reliability and workability.

Figure 2:
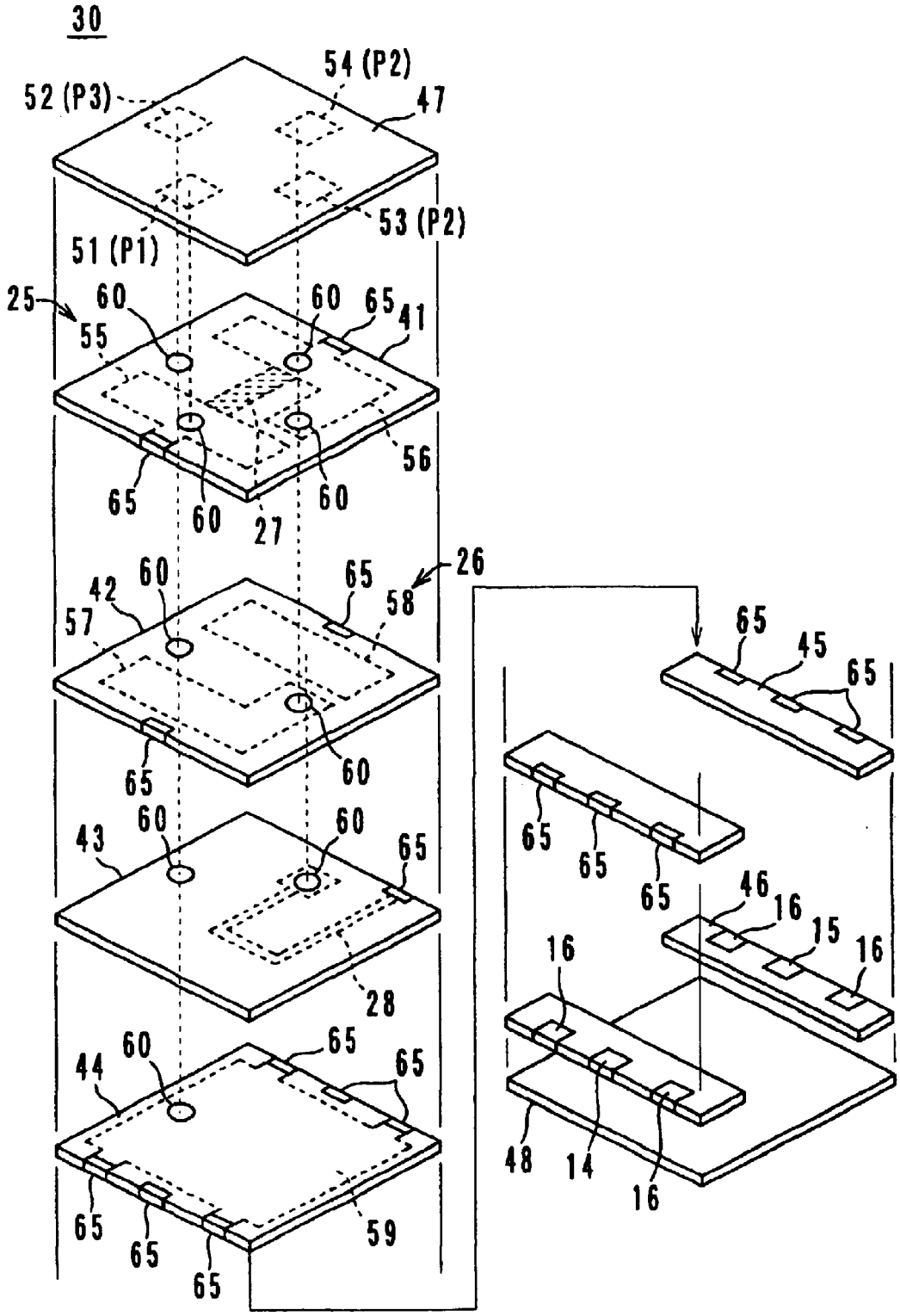
FIG. 2 is an exploded perspective view of a multilayer substrate shown in FIG. 1.

Referring to FIG. 2, the multilayer substrate 30 includes the connection electrodes 51 to 54 for the center electrodes, a dielectric sheet 41 having capacitor electrodes 55 and 56 and a resistor 27 on the back side thereof, a dielectric sheet 42 having capacitor electrodes 57 and 58 on the back surface thereof, a dielectric sheet 43 having an inductor electrode (inductor) 28 on the back surface thereof, a dielectric sheet 44 having a ground electrode 59 on the back surface thereof, dielectric sheets 45 having side via holes 65, and dielectric sheet 46 having an input outer electrode 14, an output outer electrode 15, ground electrodes 16. The connection electrode 51 for the center electrode functions as an input port P1, the connection electrodes 53 and 54 for the center electrodes function as output ports P2, and the connection electrode 52 for the center electrode functions as a third port P3.

The multilayer substrate 30 is produced in the following manner. The dielectric sheets 41 to 46 are preferably made of a low-temperature sintered dielectric material including $Al_2O_3$ as a primary ingredient and containing at least one of $SiO_2$, SrO, CaO, PbO, $Na_2O$, $K_2O$, MgO, BaO, $CeO_2$, and $B_2O_3$ as secondary ingredients.

Next, shrinkage-inhibiting sheets 47 and 48 for inhibiting the firing shrinkage in the planar direction (X-Y direction) of the multilayer substrate 30, which do not sinter under the firing condition of the multilayer substrate 30 (in particular, at a firing temperature of 1,000° C. or less), are produced. The shrinkage-inhibiting sheets 47 and 48 are preferably made of an admixture of aluminum powder and stabilized zirconia powder. The sheets 41 to 48 are preferably, for example, about 10 $\mu$m to about 200 $\mu$m in thickness.

The electrodes 28 and 51 to 58 are disposed on the back surface of the sheets 41 to 44 by pattern printing or other suitable process. The electrodes 28 and 51 to 59 are preferably made of a material, such as Ag, Cu, and AgPd, having lower resistivity and capable of being fired simultaneously with the dielectric sheets 41 to 46. The electrodes 28 and 51 to 59 are preferably, for example, about 2 $\mu$m to about 20 $\mu$m in thickness and are preferably at least about two times as thick as the skin depth of the material.

The resistor 27 is disposed on the back surface of the dielectric sheet 41 by pattern printing or other suitable process. The resistor 27 is preferably made of cermet, carbon, ruthenium, or other suitable material. The resistor 27 may be printed on the front surface of the multilayer substrate 30. The resistor 27 may be a chip resistor or other suitable type of resistor.

Via holes 60, the side via holes 65, and the outer electrodes 14 to 16 are formed by filling the via hole openings, which are perforated in advance through the dielectric sheets 41 to 46 by laser processing, punching, or other suitable process, with conductive paste.

The connection electrodes 51 to 54 for the center electrodes are provided in the vicinity of the centers of the corresponding four sides of the multilayer substrate 30. The input outer electrode 14 and the output outer electrode 15 are also provided at the central portions of two sides opposing each other.

The capacitor electrode 57, the capacitor electrode 55 that is opposed to the capacitor electrode 57, and the dielectric sheet 42 sandwiched therebetween define a first matching capacitor 25. The capacitor electrode 58, the capacitor electrode 56 that is opposed to the capacitor electrode 58, and the dielectric sheet 42 sandwiched therebetween define a second matching capacitor 26. The first matching capacitor 25 and the second matching capacitor 26, the resistor 27, and the inductor 28 define an electrical circuit inside the multilayer substrate 30, along with the electrodes 51 to 54, the outer electrodes 14 to 16, and the via holes 60 and 65.

The dielectric sheets 41 to 46 described above are layered. The layered dielectric sheets 41 to 46 that are sandwiched between the shrinkage-inhibiting sheets 47 and 48 are fired, thereby producing a sintered body. Shrinkage-inhibiting materials that have not been sintered are removed from the sintered body by ultrasonic cleaning, wet honing, or other suitable process to produce the multilayer substrate 30 shown in FIG. 1.

One side panel of the multilayer substrate 30 is provided with the input outer electrode 14 and the ground electrodes 16, and the other side panel of the multilayer substrate 30 is provided with the output outer electrode 15 and the ground electrodes 16. The input outer electrode 14 is electrically connected to the capacitor electrode 55 and the output outer electrode 15 is electrically connected to the capacitor electrode 56. The ground electrodes 16 are electrically connected to the corresponding ends of the inductor electrode 28 and the ground electrode 59. The multilayer substrate 30 is preferably plated with Ni, which is then preferably plated with Au. The Ni plating increases the bonding strength between the electrodes made of Ag and the Au plating. The Au plating improves the solder wettability and it has a high conductivity, thus reducing the loss of the isolator 1.

The multilayer substrate 30 is ordinarily produced in the form of a motherboard. Cutting half-cut grooves in the motherboard at a predetermined pitch and folding the motherboard along the half-cut grooves produce the multilayer substrate 30 having a desired size. Alternatively, cutting off part of the motherboard with a dicer, a laser, or other suitable cutting device or process produces a multilayer substrate 30 having a desired size.

The multilayer substrate 30 produced in the manner described above includes the matching capacitors 25 and 26, the resistor 27, and the inductor 28. The matching capacitors 25 and 26 are produced with required capacitance accuracy. The matching capacitors 25 and 26 are trimmed off, if required, before they are fixed to the center electrodes 21 and 22. In other words, the capacitor electrodes 55 and 56 (beneath the second layer) in the single multilayer substrate 30 are trimmed off (cut out) along with the surface dielectric material. For example, a cutting machine or a YAG (yttrium, aluminium, and garnet) laser providing a fundamental wave, a second harmonic wave, or a third harmonic wave is used for the trimming. Use of the laser permits quick processing with higher accuracy. Meanwhile, the multilayer substrate 30 in the form of a motherboard may be efficiently trimmed off.

Because the capacitor electrodes 55 and 56 near the top surface of the multilayer substrate 30 are used as capacitor electrodes for trimming, as described above, the depth of the dielectric layer that is trimmed off can be minimized. Furthermore, the number of electrodes that impede the trimming is decreased (only the connection electrodes 51 to 54 impede the trimming according to the first preferred embodiment), so that the area for the capacitor electrode that can be trimmed off is extended, thus expanding the range within which the capacitance is adjusted.

The resistor 27 is also included in the multilayer substrate 30. Like the matching capacitors 25 and 26, trimming off the resistor 27 along with the surface dielectric material allows a resistance R to be adjusted. Because the resistance R increases if only part of the resistor 27 becomes thin, the resistor 27 is partially trimmed off widthwise.

The components described above are assembled in the following manner. Namely, as shown in FIG. 1, the permanent magnet 9 is adhered to the ceiling of the metallic top case 4 with an adhesive. Applying solder 80 to the connection electrodes 51 to 54 on the multilayer substrate 30 to electrically connect them to the ends 21*a* and 21*b* of the first center electrode 21 and the ends 22*a* and 22*b* of the second center electrode 22 in the center electrode assembly 13 mounts the center electrode assembly 13 on the multilayer substrate 30. Fixing the connection electrodes 51 to 54 for the center electrodes to the center electrodes 21 and 22 with solder may be efficiently performed on the multilayer substrate 30 in the form of a motherboard.

The multilayer substrate 30 is placed on the bottom surface 8*a* of the metallic bottom case 8. The ground electrode 59 disposed beneath the multilayer substrate 30 is fixed to the bottom surface 8*a* with the solder 80, thereby electrically connecting the ground electrode 16 to the bottom surface 8*a* with ease.

The metallic bottom case 8 and the metallic top case 4 are fixed to the side surfaces 8*b* and the side surfaces 4*b* with solder or other suitable material, respectively, to form a metallic case that also functions as a yoke. In other words, the metallic case defines a magnetic path surrounding the permanent magnet 9, the center electrode assembly 13, and the multilayer substrate 30. The permanent magnet 9 applies a DC magnetic field to the ferrite 20.

Figure 3:
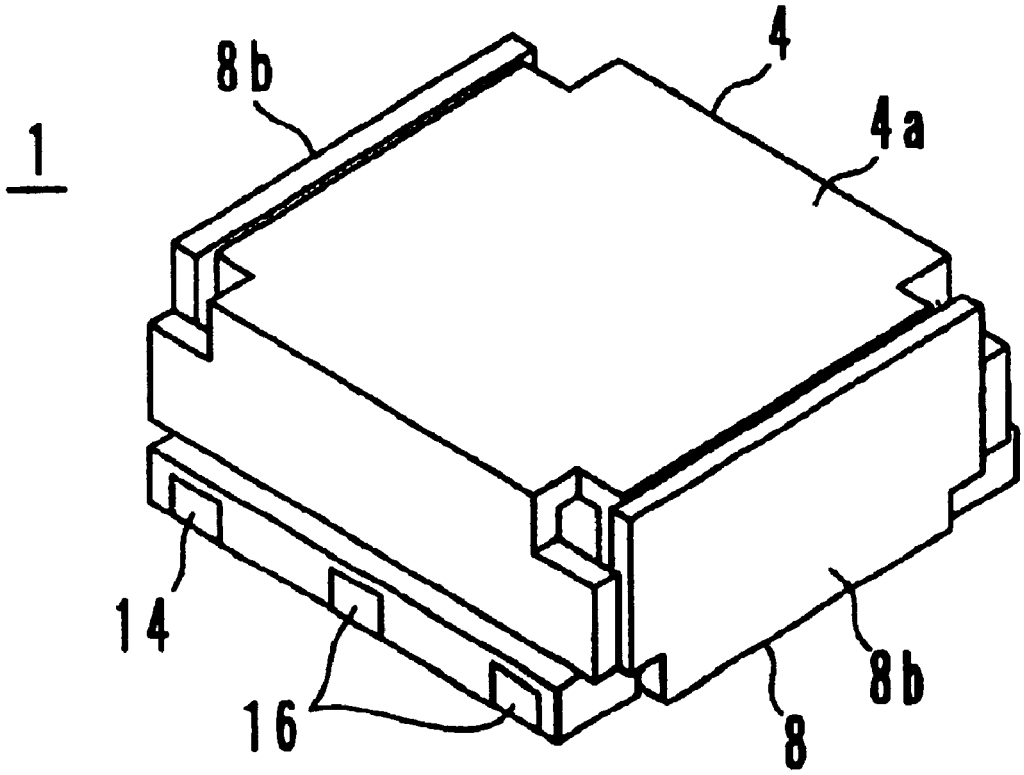
FIG. 3 is an external perspective view of the two-port isolator shown in FIG. 1.
Figure 4:
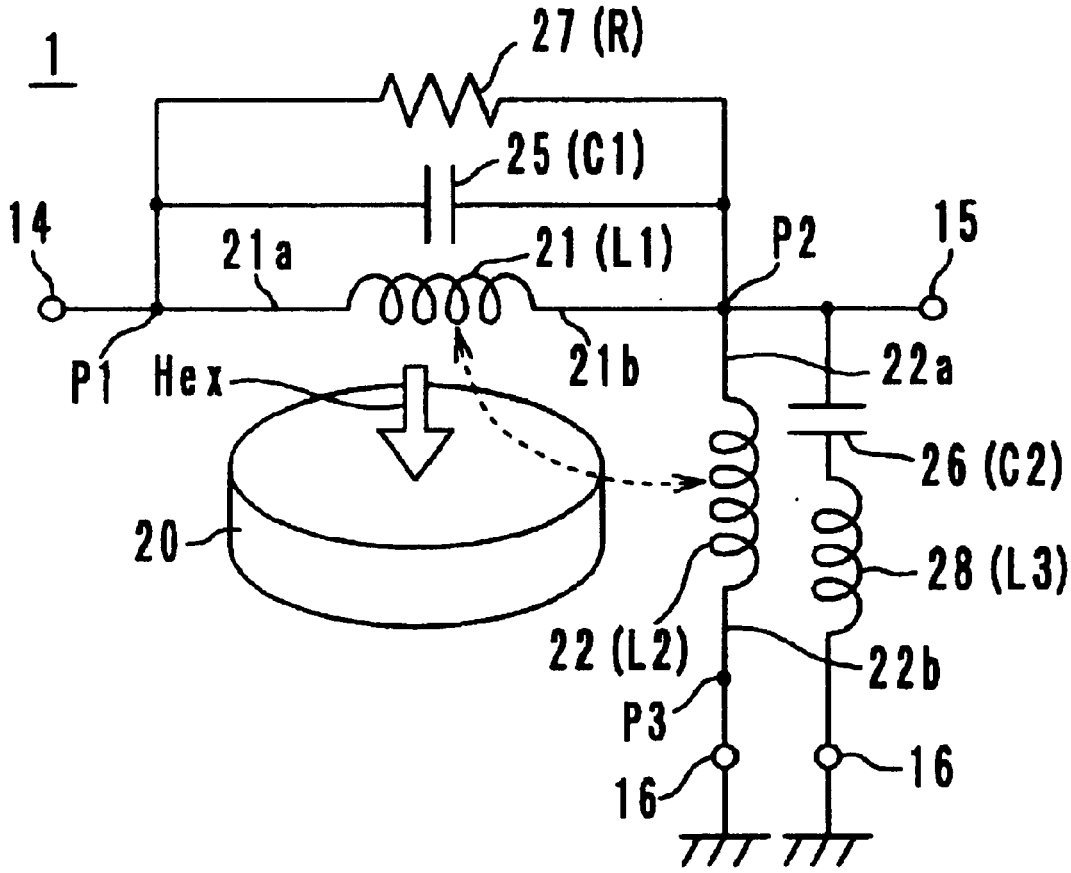
FIG. 4 is an equivalent circuit diagram of the two-port isolator shown in FIG. 1.

The two-port isolator 1 in FIG. 3 is preferably formed in this manner. FIG. 4 is an equivalent circuit diagram of the isolator 1. One end 21*a* of the first center electrode 21 is electrically connected to the input outer electrode 14 through the input port P1 (the connection electrode 51 for the center electrode). The other end 21*b* of the first center electrode 21 is electrically connected to the output outer electrode 15 through the output port P2 (the connection electrode 54 for the center electrode). One end 22*a* of the second center electrode 22 is electrically connected to the output outer electrode 15 through the output port P2 (the connection electrode 53 for the center electrode). The other end 22*b* of the second center electrode 22 is electrically connected to the ground electrode 16 through the third port P3 (the connection electrode 52 for the center electrode). A parallel RC circuit including the first matching capacitor 25 and the resistor 27 is electrically connected between the input port P1 and the output port P2. A series resonant circuit including the second matching capacitor 26 and the inductor 28 is electrically connected between the output port P2 and the ground. The third port P3 is electrically grounded.

The position of the second matching capacitor 26 can be switched to the position of the inductor 28. That is, the inductor 28 may be connected to the output port P2 side and the second matching capacitor 26 may be connected to the ground side.

The two-port isolator 1 having the structure described above has the series resonant circuit including the second matching capacitor 26 and the inductor 28 between the output port P2 and the ground. This series resonant circuit functions as a trap circuit. The resonant frequency of the trap circuit is preferably set between the frequency (2*f*) of the second harmonic wave and the frequency (3*f*) of the third harmonic wave, where f denotes the frequency used. The trap circuit produces an attenuation pole between the second harmonic wave (2*f*) and the third harmonic wave (3*f*), thus increasing the attenuation of the second harmonic wave (2*f*) and the third harmonic wave (3*f*) that is propagated through the first center electrode 21.

The admittance Y and the resonant frequency f(0) of the trap circuit described above are given by the following equations (1) and (2):

$$Y=(\omega C2)/j(\omega^2 L3C2-1),\ \omega=2\pi f \quad (1)$$

$$f(0)=1/\{2\pi(L3C2)^{1/2}\} \quad (2)$$

Figure 5:
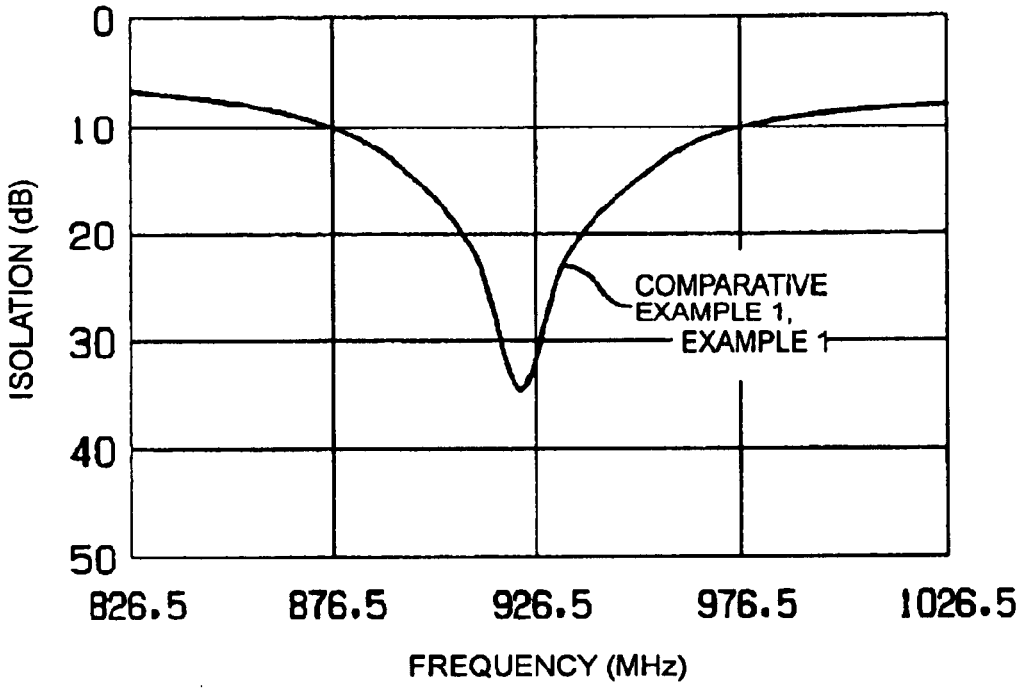
FIG. 5 is a graph showing the isolation characteristic of the two-port isolator shown in FIG. 1.
Figure 6:
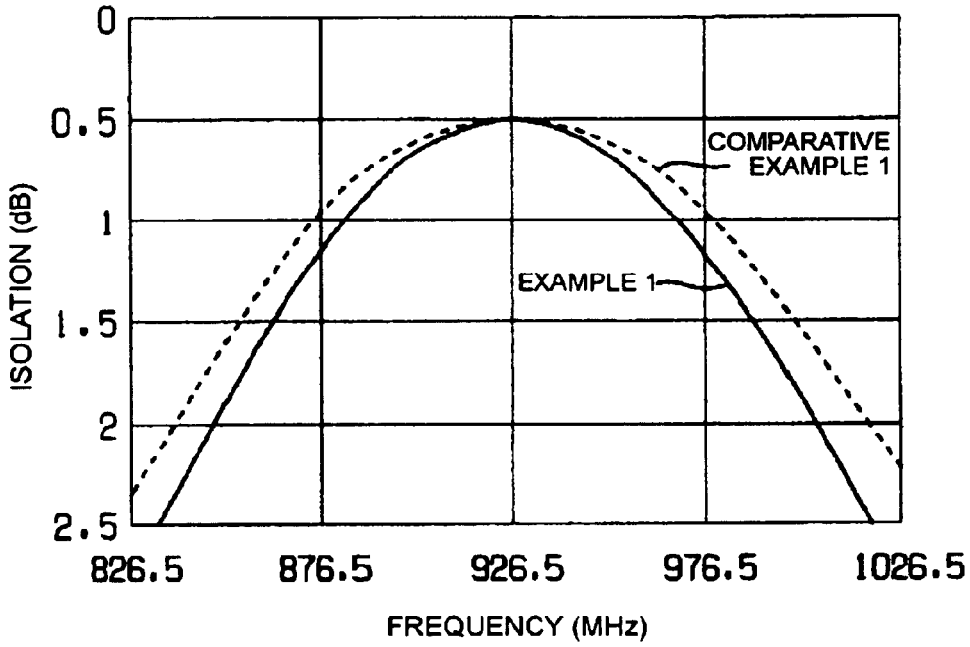
FIG. 6 is a graph showing the insertion loss characteristic of the two-port isolator shown in FIG. 1.
Figure 7:
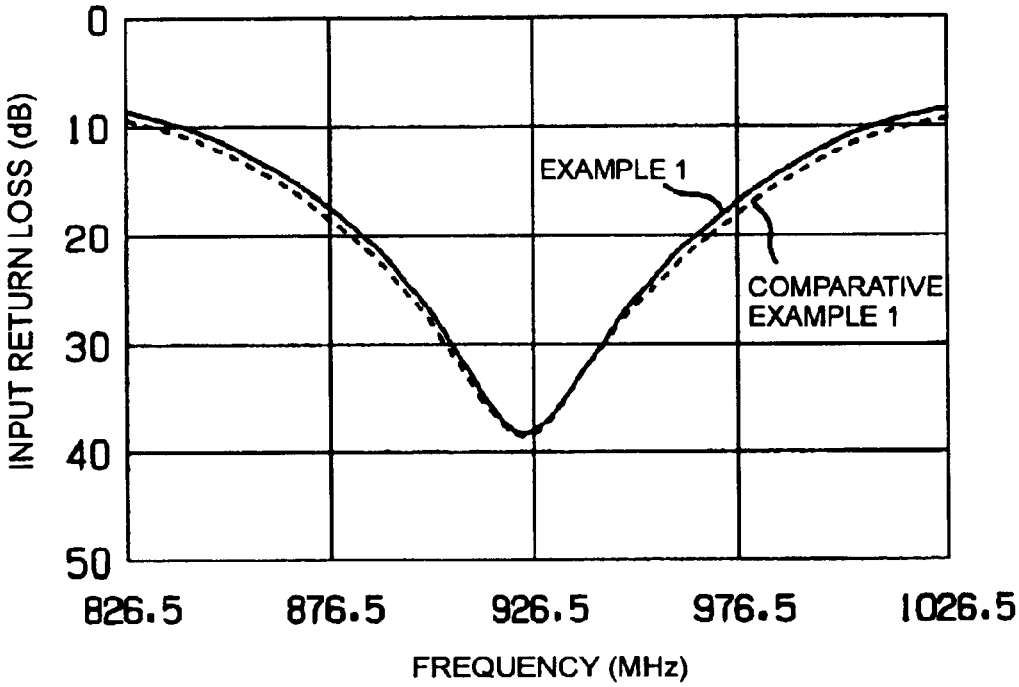
FIG. 7 is a graph showing the input return loss characteristic of the two-port isolator shown in FIG. 1.
Figure 8:
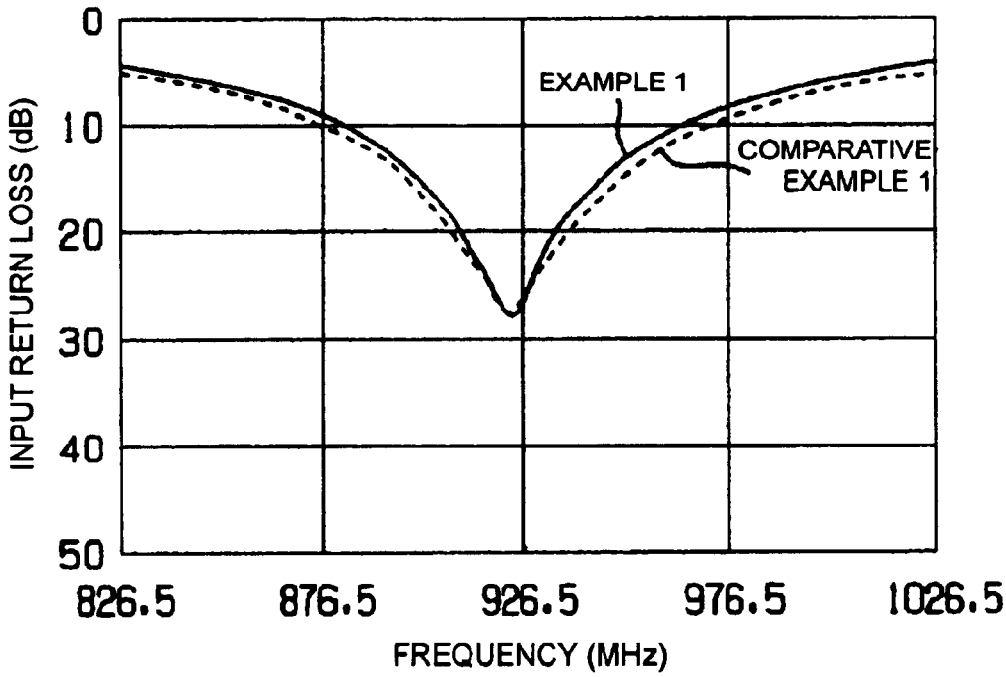
FIG. 8 is a graph showing the output return loss characteristic of the two-port isolator shown in FIG. 1.
Figure 9:
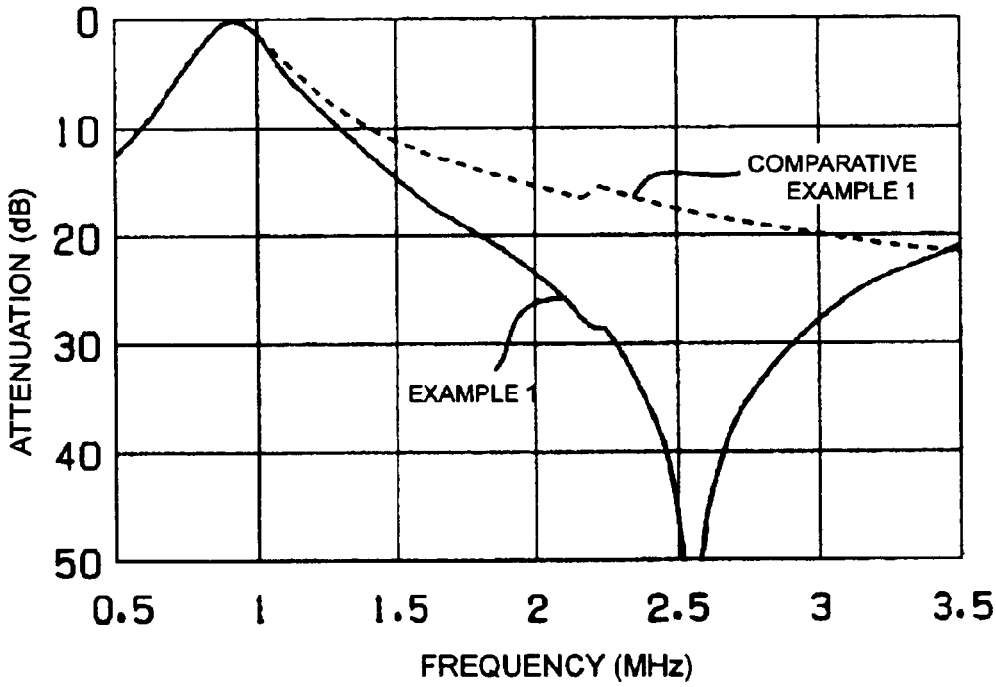
FIG. 9 is a graph showing the attenuation characteristic of the two-port isolator shown in FIG. 1.
Figure 21:
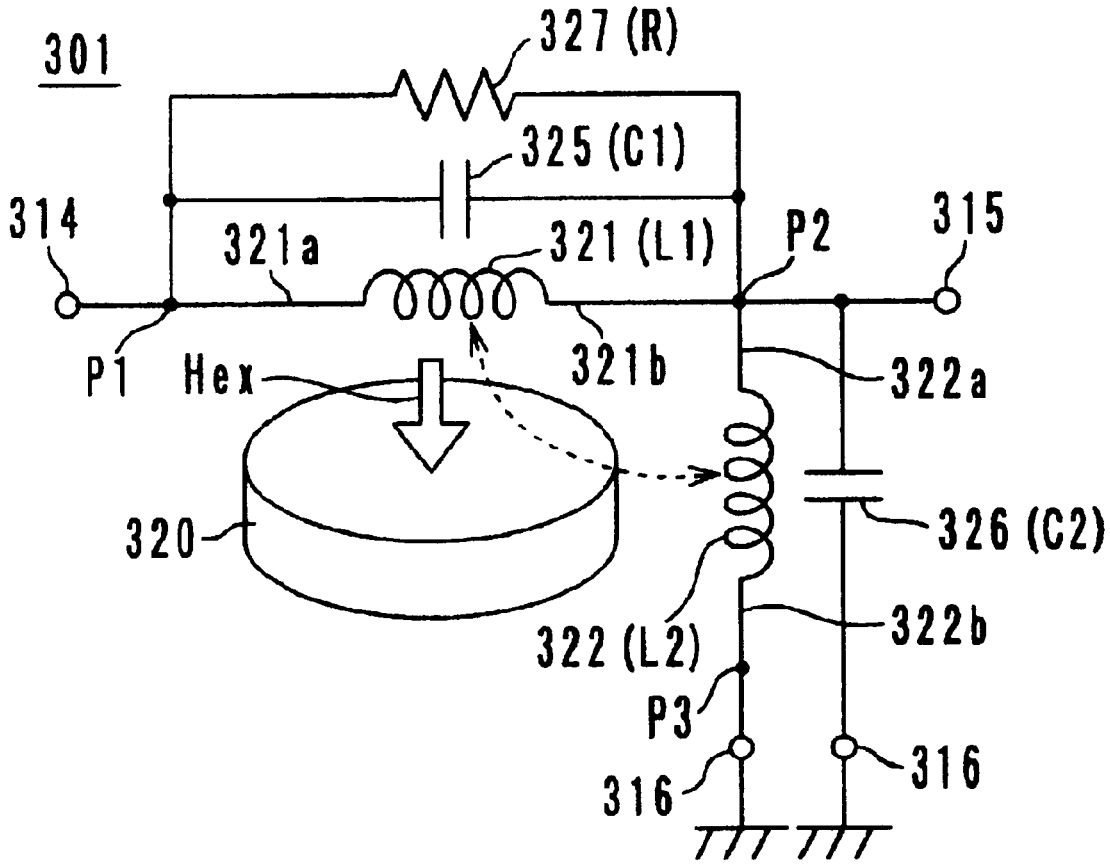
FIG. 21 PRIOR ART
FIG. 21 is an equivalent circuit diagram of a conventional two-port isolator.

FIG. 5 is a graph showing the isolation characteristic of the two-port isolator 1. FIG. 6 is a graph showing the insertion loss characteristic thereof. FIG. 7 is a graph showing the input return loss characteristic thereof. FIG. 8 is a graph showing the output return loss characteristic thereof. FIG. 9 is a graph showing the attenuation characteristic thereof (refer to the solid lines of example 1). For comparison, FIGS. 5 to 9 also show the characteristics of the known two-port isolator 301 of FIG. 21 (refer to the broken lines of comparative example 1). Table 1-1 shows the inductances of the first center electrode 21 and the second center electrode 22, the capacitances C1 and C2 of the matching capacitors 25 and 26, and the inductance L3 of the inductor 28.

In this case, the ferrite 20 is about 2.0 mm in diameter and about 0.4 mm in thickness. The center electrodes 21 and 22 have a width W of about 0.2 mm and a length 1 of about 2 mm and are arranged at an interval S of about 0.2 mm, thereby setting the self-inductance to about 0.7 nH. The resistance R of the resistor 27 is preferably about 60Ω. The inductances of the center electrodes 21 and 22 in Table 1-1 denote the self-inductance on the assumption that the relative permeability is one. In practice, the inductances L1 and L2 are given by multiplying the inductances in Table 1-1 by the effective permeability due to the ferrite 20. In Example 1, the admittance Y of the series resonant circuit including the second matching capacitor 26 preferably having a capacitance of about 19 pF and the inductor 28 preferably having an inductance of about 0.2 nH is substantially equal to the admittance of the capacitor preferably having a capacitance of about 22 pF within the bandwidth between about 893 MHz and 960 about MHz based on equation (1) mentioned above. The resonant frequency f(0) of the series resonant circuit is preferably about 2.6 GHz based on equation (2) mentioned above.

Table 1-2 shows the worst cases within the bandwidth between about 893 MHz and about 960 MHz, the attenuation of the second harmonic wave (1786 MHz to 1920 MHz), and the attenuation of the third harmonic wave (2679 MHz to 2880 MHz).

TABLE 1-1

| | Self inductance of first center electrode 21 | Self inductance of second center electrode 22 | Capacitance C1 of matching capacitor 25 | Capacitance C2 of matching capacitor 26 | Inductance L3 of inductor 28 |
|---|---|---|---|---|---|
| Comparative example 1 | 0.7 nH | 0.7 nH | 22 pF | 22 pF | — |
| Example 1 | 0.7 nH | 0.7 nH | 22 pF | 19 pF | 0.2 nH |

TABLE 1-2

| | Input return loss (dB) | Insertion loss (dB) | Isolation (Db) | Output return loss (dB) | Attenuation of second harmonic wave (dB) | Attenuation of third harmonic wave (dB) |
|---|---|---|---|---|---|---|
| Comparative example 1 | 22.4 | 0.75 | 12.2 | 11.8 | 14.0 | 18.7 |
| Example 1 | 21.5 | 0.84 | 12.3 | 10.9 | 19.5 | 30.3 |

According to the first preferred embodiment of the present invention, the input outer electrode 14 and the output outer electrode 15 are placed at the respective middle positions of a pair of side surfaces opposing each other. Hence, when the isolator 1 is mounted on a printed circuit board of a mobile phone and other suitable communication devices, rotating the isolator 1 at an angle of 180° allows the isolator 1 to be mounted on a printed circuit board on which input-signal lines and output-signal lines are placed such that left and right are reversed. This eliminates the need to produce two kinds of isolators 1 in accordance with the direction of the input-signal lines and the output-signal lines on the printed circuit board, thus reducing the cost of the isolator 1.

In particular, in the two-port isolator 1, the frequency characteristics of the return loss when the port P1 functions as the input port greatly differs from the frequency characteristics of the return loss when the port P2 functions as the input port. Hence, it is necessary to produce two kinds of isolators 1 that have inverted magnetic-field direction (the N-S direction of the permanent magnet 9 is inverted) and different internal structures. Accordingly, the cost of the two-port isolator 1 is largely reduced if two such kinds of isolators 1 are not required.

Because the multilayer substrate 30 includes the matching capacitors 25 and 26 and the inductor 28, the number of points where the matching capacitors 25 and 26 and the inductor 28 are fixed to each other with solder can be reduced, thus achieving the isolator 1 having higher connection reliability. Furthermore, the parts and the production processes can be reduced in number to realize the low-cost isolator 1.

Figure 10:
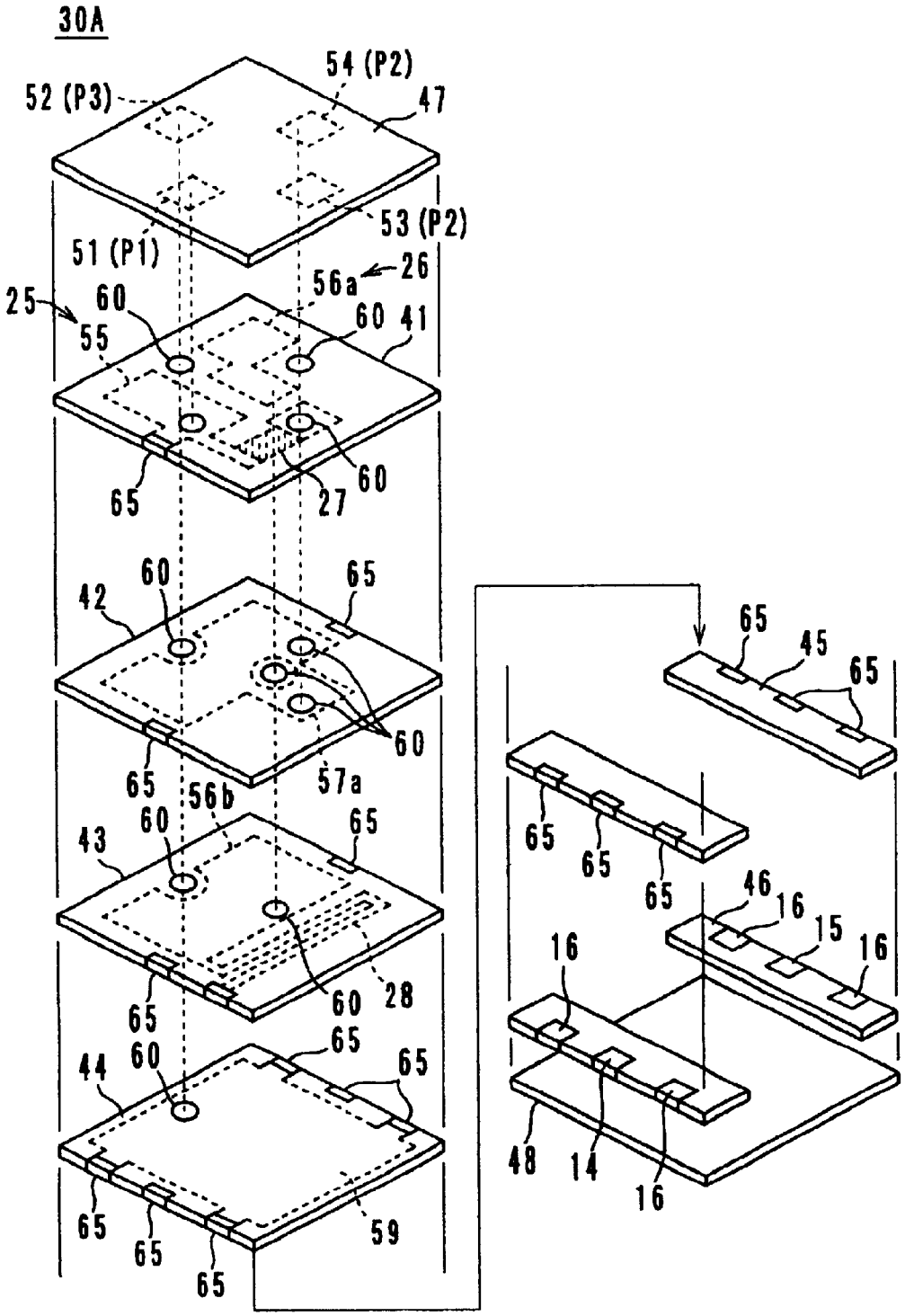
FIG. 10 is an exploded perspective view showing a modification of the multilayer substrate shown in FIG. 1.

The multilayer substrate 30 can be modified in various ways. For example, a multilayer substrate 30A shown in FIG. 10 includes the connection electrodes 51 to 54 for the center electrodes, a dielectric sheet 41 having the capacitor electrode 55, a capacitor electrode 56*a*, and the resistor 27 on the back surface thereof, a dielectric sheet 42 having a capacitor electrode 57*a* on the back surface thereof, a dielectric sheet 43 having a capacitor electrode 56*b* and the inductor electrode 28 on the back surface thereof, a dielectric sheet 44 having the ground electrode 59 on the back surface thereof, and dielectric sheets 46 having the input outer electrode 14, the output outer electrode 15, and the ground electrodes 16. The connection electrode 51 for the center electrode functions as the input port P1, the connection electrodes 53 and 54 for the center electrodes function as the output ports P2, and the connection electrode 52 for the center electrode functions as the third port P3.

The capacitor electrode 55, the capacitor electrode 57*a*, the left half of which is substantially opposed to the capacitor electrode 55, and the dielectric sheet 42 sandwiched between the capacitor electrodes 55 and 57*a* define a first matching capacitor 25. The capacitor electrodes 56*a* and 56*b* the capacitor electrode 57*a* that is opposed to the capacitor electrodes 56*a* and 56*b* define a second matching capacitor 26 by sandwiching dielectric sheets 42 and 43 between the capacitor electrodes 56*a* and 56*b*. The matching capacitors 25 and 26, the resistor 27, and the inductor 28 define an electrical circuit inside the multilayer substrate 30A, along with the electrodes 51 to 54, the outer electrodes 14 to 16, and the via holes 60 and 65.

Figure 11:
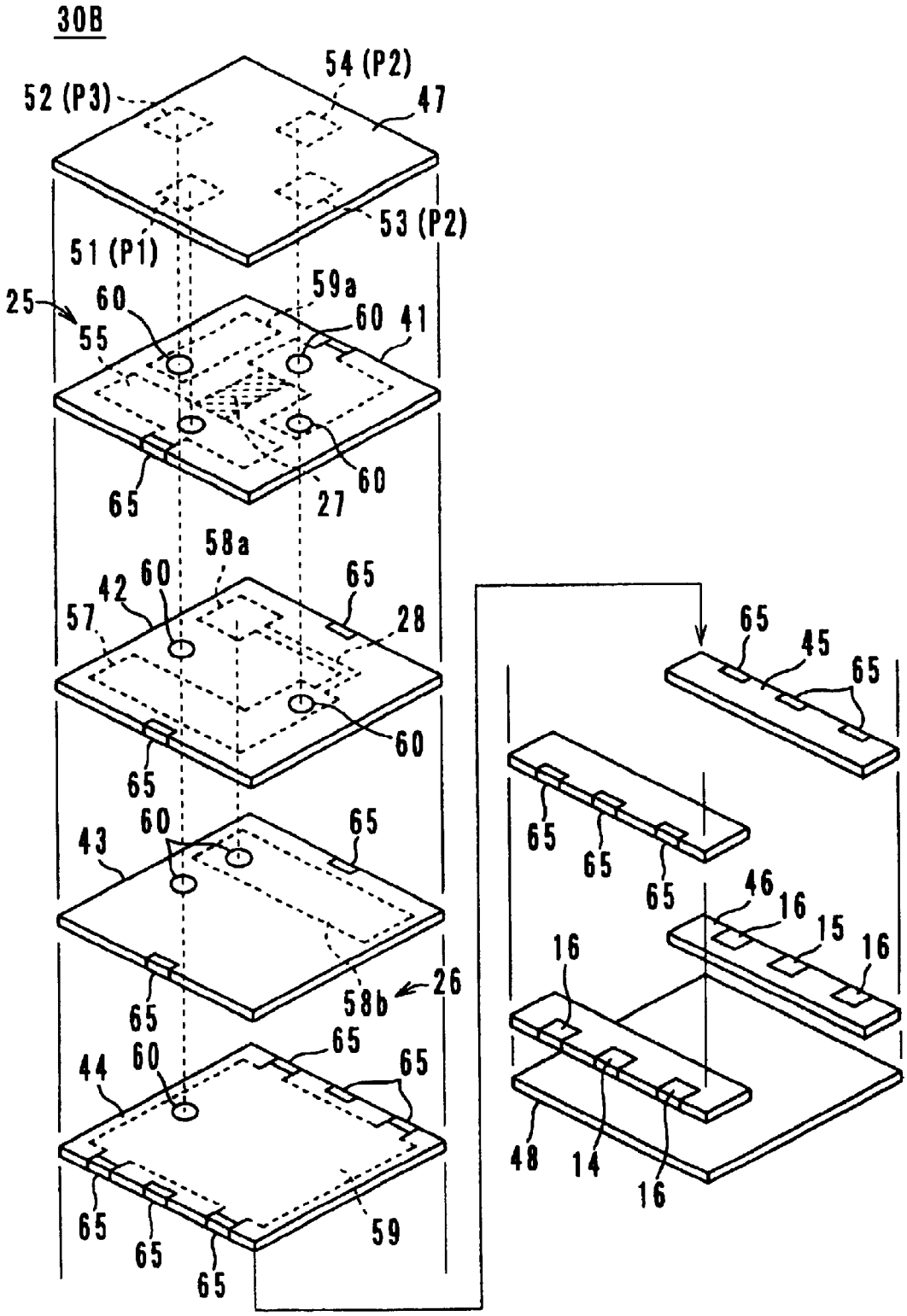
FIG. 11 is an exploded perspective view showing another modification of the multilayer substrate shown in FIG. 1.

A multilayer substrate 30B shown in FIG. 11 includes the connection electrodes 51 to 54 for the center electrodes, a dielectric sheet 41 having the capacitor electrode 55, a capacitor electrode 59*a*, and the resistor 27 on the back surface thereof, a dielectric sheet 42 having the capacitor electrode 57, a capacitor electrode 58*a*, and the inductor electrode 28 on the back surface thereof, a dielectric sheet 43 having a capacitor electrode 58*b* on the back surface thereof, a dielectric sheet 44 having the ground electrode 59 on the back surface thereof, and dielectric sheets 46 having the input outer electrode 14, the output outer electrode 15, and the ground electrodes 16.

The capacitor electrode 55, the capacitor electrode 57 that is opposed to the capacitor electrode 55, and the dielectric sheet 42 sandwiched therebetween define a first matching capacitor 25. The capacitor electrodes 58*a* and 58*b*, the capacitor electrode 59*a* that is opposed to the capacitor electrode 58*a* with the dielectric sheet 42 sandwiched therebetween, and the ground electrode 59 that is opposed to the capacitor electrode 58*b* with the dielectric sheet 44 sandwiched therebetween define a second matching capacitor 26. The matching capacitors 25 and 26, the resistor 27, and the inductor 28 define an electrical circuit inside the multilayer substrate 30B, along with the electrodes 51 to 54, the outer electrodes 14 to 16, and the via holes 60 and 65.

A two-port isolator according to a second preferred embodiment is similar to the two-port isolator 1 according to the first preferred embodiment except for a multilayer substrate. Hence, the exploded perspective view and the external perspective view of the two-port isolator of the second preferred embodiment are similar to those shown in FIGS. 1 and 3 according to the first preferred embodiment of the present invention.

Figure 12:
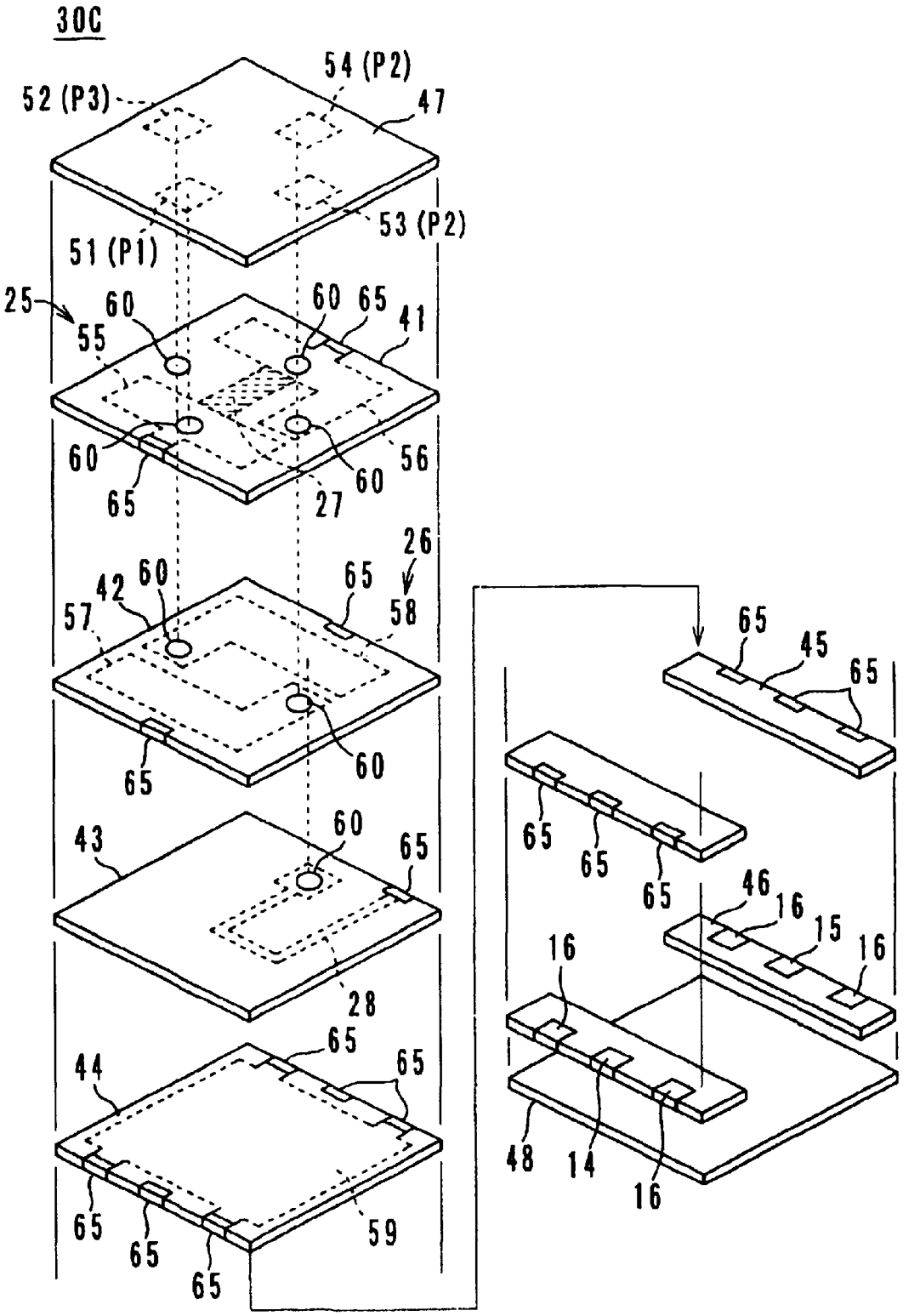
FIG. 12 is an exploded perspective view of a multilayer substrate used in a two-port isolator according to the second preferred embodiment of the present invention.

Referring to FIG. 12, a multilayer substrate 30C includes the connection electrodes 51 to 54 for the center electrodes, a dielectric sheet 41 having the capacitor electrodes 55 and 56 and the resistor 27 on the back surface thereof, a dielectric sheet 42 having the capacitor electrodes 57 and 58 on the back surface thereof, a dielectric sheet 43 having the inductor 28 on the back surface thereof, a dielectric sheet 44 having the ground electrode 59 on the back surface thereof, and dielectric sheets 46 having the input outer electrode 14, the output outer electrode 15, and the ground electrodes 16. The multilayer substrate 30C is preferably produced in the same manner as the multilayer substrate 30 of the first preferred embodiment.

The capacitor electrode 57, the capacitor electrode 55 that is opposed to the capacitor electrode 57, and the dielectric sheet 42 sandwiched therebetween define a matching capacitor 25. The capacitor electrode 58, the capacitor electrode 56 that is opposed to the capacitor electrode 58, and the dielectric sheet 42 sandwiched therebetween define a matching capacitor 26.

Figure 13:
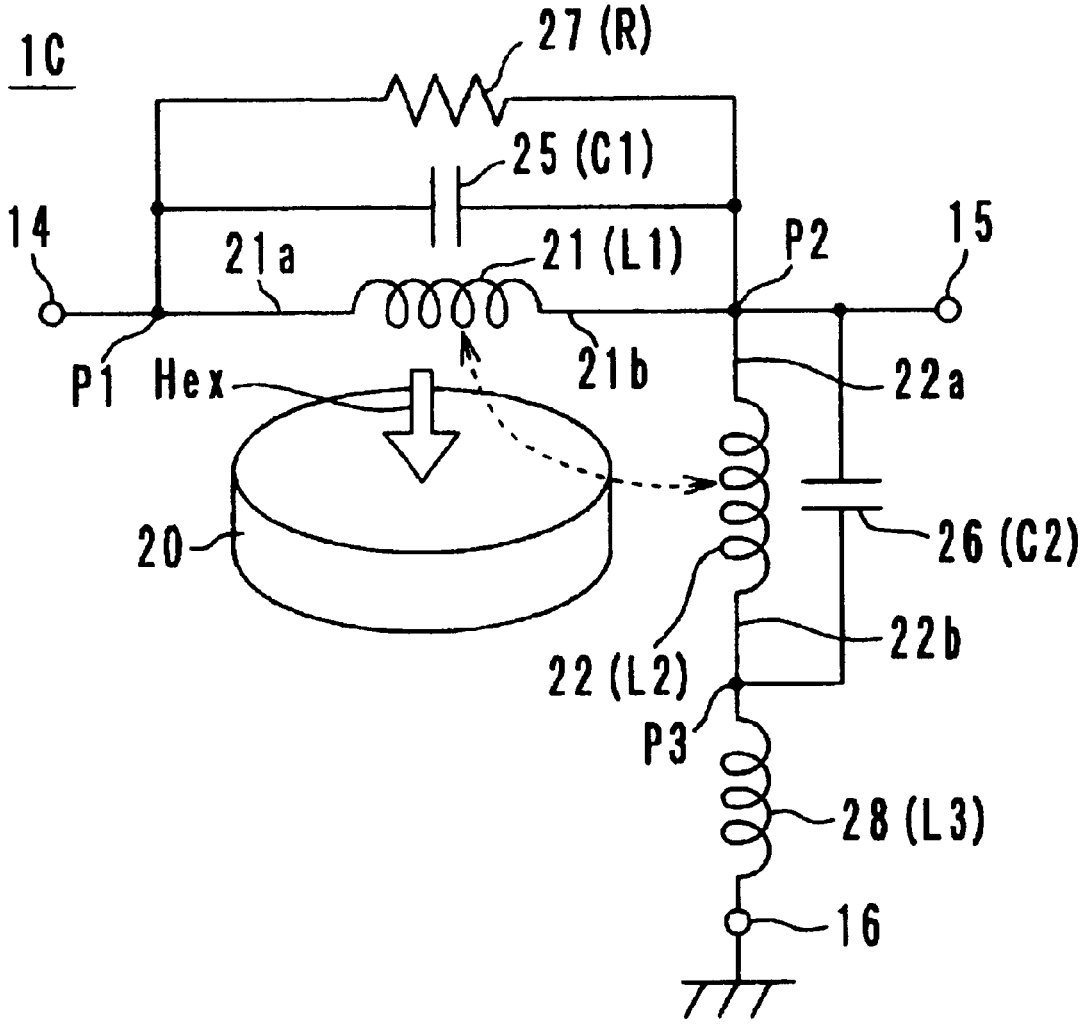
FIG. 13 is an equivalent circuit diagram of the two-port isolator using the multilayer substrate shown in FIG. 12.

FIG. 13 is an equivalent circuit diagram of a two-port isolator 1C having the multilayer substrate 30C shown in FIG. 12. A parallel circuit including the first center electrode 21, the first matching capacitor 25, and the resistor 27 is connected between the input port P1 and the output port P2. A parallel circuit including the second center electrode 22 and the second matching capacitor 26 is connected between the output port P2 and the third port P3. The inductor 28 is connected between the third port P3 and the ground electrodes 16.

In the two-port isolator 1C having the structure described above, a parallel resonant circuit, including the second center electrode 22 and the second matching capacitor 26, and the inductor 28 are electrically connected in series between the output port P2 and the ground. The circuit including the LC parallel resonant circuit and the series inductor functions as a trap circuit. The resonant frequency of the trap circuit is preferably set between the frequency (2*f*) of the second harmonic wave and the frequency (3*f*) of the third harmonic wave, where f denotes the frequency used. The trap circuit produces an attenuation pole between the second harmonic wave and the third harmonic wave, thus increasing the attenuation of the second harmonic wave and the third harmonic wave that is propagated through the first center electrode 21 without degrading the insertion loss characteristic.

Figure 14:
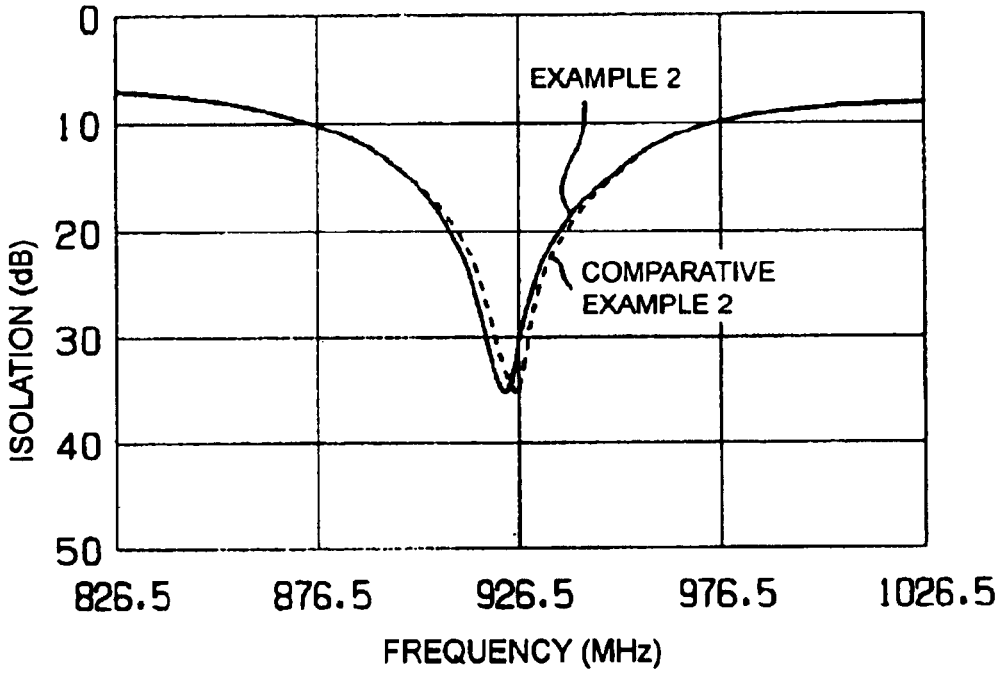
FIG. 14 is a graph showing the isolation characteristic of the two-port isolator shown in FIG. 12.
Figure 15:
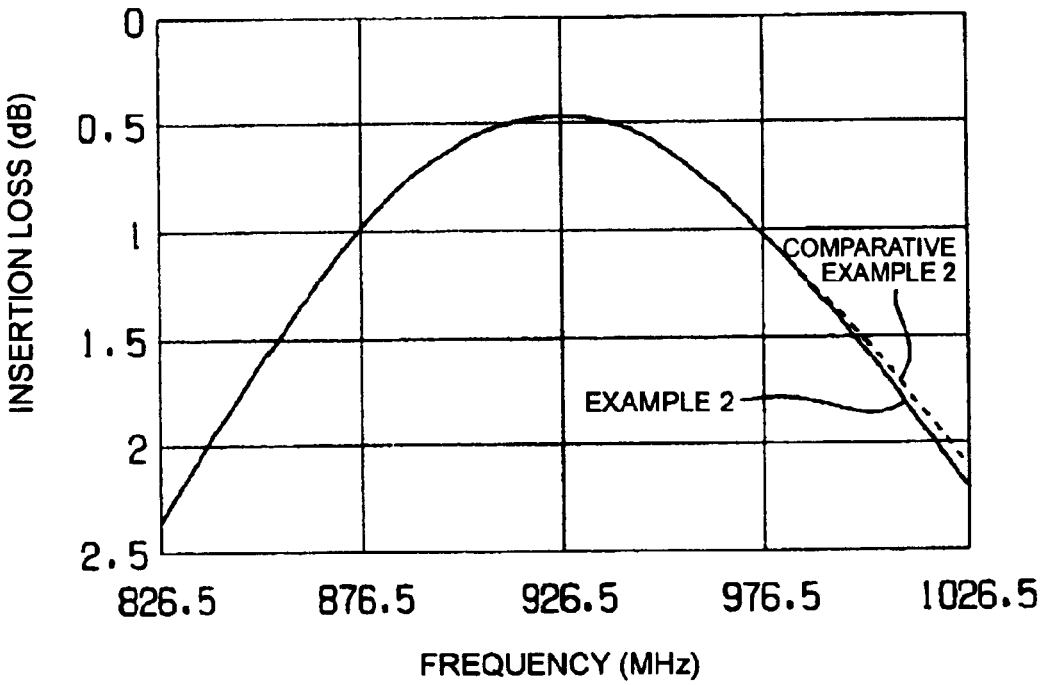
FIG. 15 is a graph showing the insertion loss characteristic of the two-port isolator shown in FIG. 12.
Figure 16:
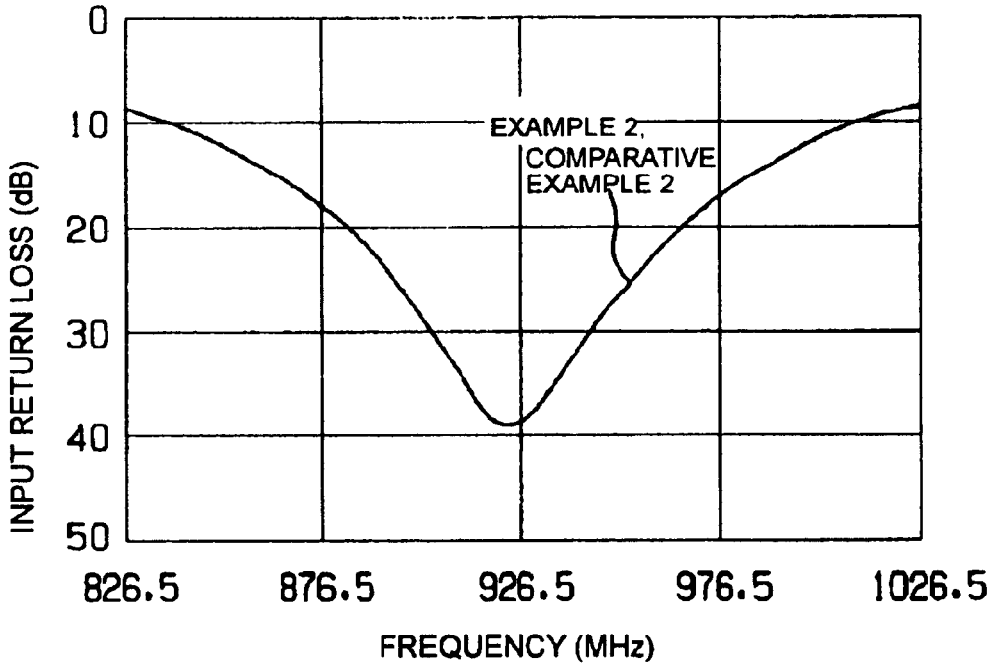
FIG. 16 is a graph showing the input return loss characteristic of the two-port isolator shown in FIG. 12.
Figure 17:
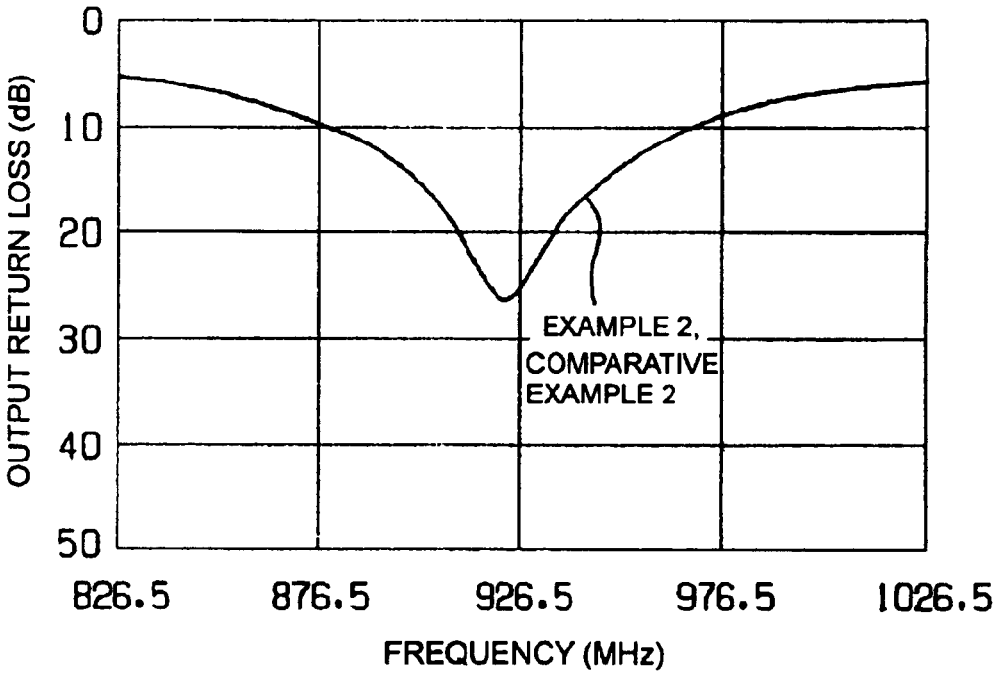
FIG. 17 is a graph showing the output return loss characteristic of the two-port isolator shown in FIG. 12.
Figure 18:
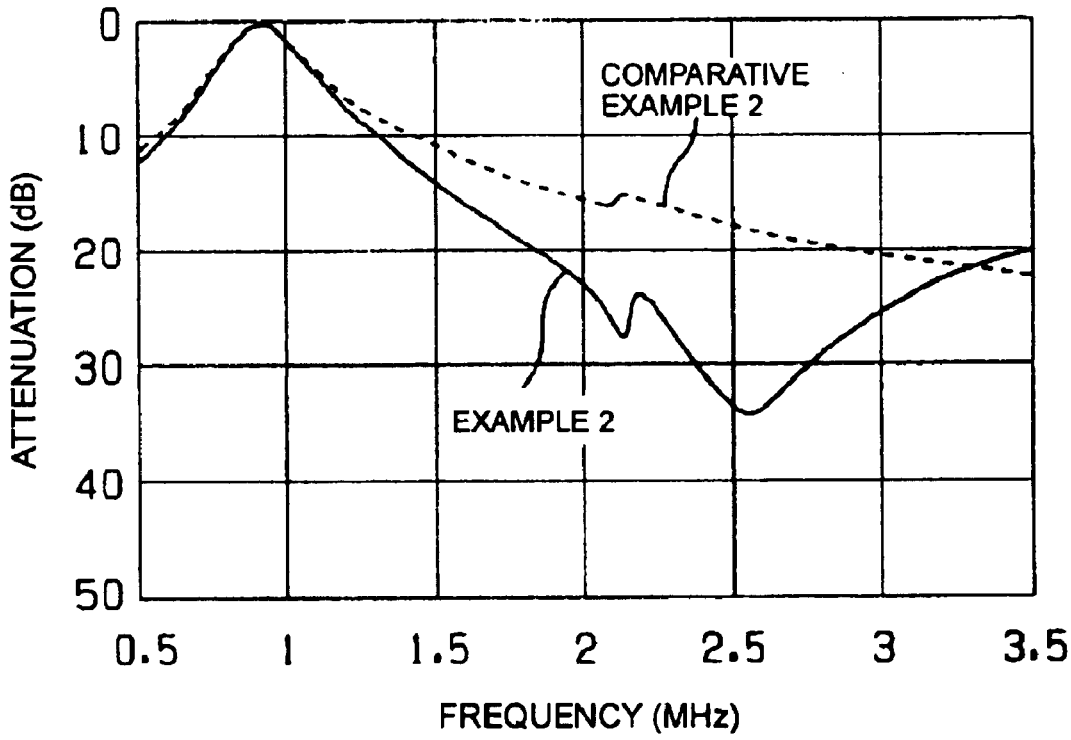
FIG. 18 is a graph showing the attenuation characteristic of the two-port isolator shown in FIG. 12.

FIG. 14 is a graph showing the isolation characteristic of the two-port isolator 1C. FIG. 15 is a graph showing the insertion loss characteristic thereof. FIG. 16 is a graph showing the input return loss characteristic thereof. FIG. 17 is a graph showing the output return loss characteristic thereof. FIG. 18 is a graph showing the attenuation characteristic thereof (refer to the solid lines of example 2). For comparison, FIGS. 14 to 18 also show the characteristics of the known two-port isolator 301 in FIG. 21 (refer to the broken lines of comparative example 2). Table 2-1 shows the inductances of the first center electrode 21 and the second center electrode 22, the capacitances C1 and C2 of the matching capacitors 25 and 26, and the inductance L3 of the inductor 28.

The resistance R of the resistor 27 is preferably about 60Ω. The inductances shown in Table 2-1 denote the self-inductance of the center electrodes 21 and 22 on the assumption that the relative permeability is one. In practice, the inductances L1 and L2 are given by multiplying the inductances in Table 2-1 by the effective permeability due to the ferrite 20.

The impedance Z and the resonant frequency f(0) of the trap circuit of the second preferred embodiment are given by the following equations (3) and (4):

$$Z=j\{\omega L3-\omega L2/(\omega^2 L3C2-1)\} \quad (3)$$

$$f(0)=1/2\pi\cdot[\{(L2/L3)+1\}/(L2C2)]^{1/2}=1/2\pi\cdot[1/C2\cdot\{(1/L2)+(1/L3)\}]^{1/2} \quad (4)$$

Hence, for example, the resonant frequency of the trap circuit becomes about 2.6 GHz based on equation (4) using the self-inductance of the second center electrode 22, the capacitance C2 of the matching capacitor 26, and the inductance L3 of the inductor 28 shown in Table 2-1, on the assumption that the effective permeability is two. In this case, the inductance L2 is given by multiplying the self inductance of the second center electrode 22 by the effective permeability that is two.

Table 2-2 shows the worst value within the bandwidth between about 893 MHz and about 960 MHz, the attenuation of the second harmonic wave (1786 MHz to 1920 MHz), and the attenuation of the third harmonic wave (2679 MHz to 2880 MHz) of the two-port isolator 1C of Example 2 and the two-port isolator 301 of Comparative Example 2.

TABLE 2-1

| | Self inductance of first center electrode 21 | Self inductance of second center electrode 22 | Capacitance C1 of matching capacitor 25 | Capacitance C2 of matching capacitor 26 | Inductance L3 of inductor 28 |
|---|---|---|---|---|---|
| Comparative example 2 | 0.7 nH | 0.7 nH | 22 pF | 22 pF | — |
| Example 2 | 0.7 nH | 0.7 nH | 22 pF | 22 pF | 0.2 nH |

TABLE 2-2

| | Input return loss (dE) | Insertion loss (dB) | Isolation (dE) | Output return loss (dB) | Attenuation of second harmonic wave (dE) | Attenuation of third harmonic wave (dB) |
|---|---|---|---|---|---|---|
| Comparative example 2 | 22.4 | 0.75 | 12.2 | 11.8 | 14.0 | 18.7 |
| Example 2 | 22.7 | 0.75 | 11.9 | 11.8 | 18.7 | 27.5 |

Figure 19:
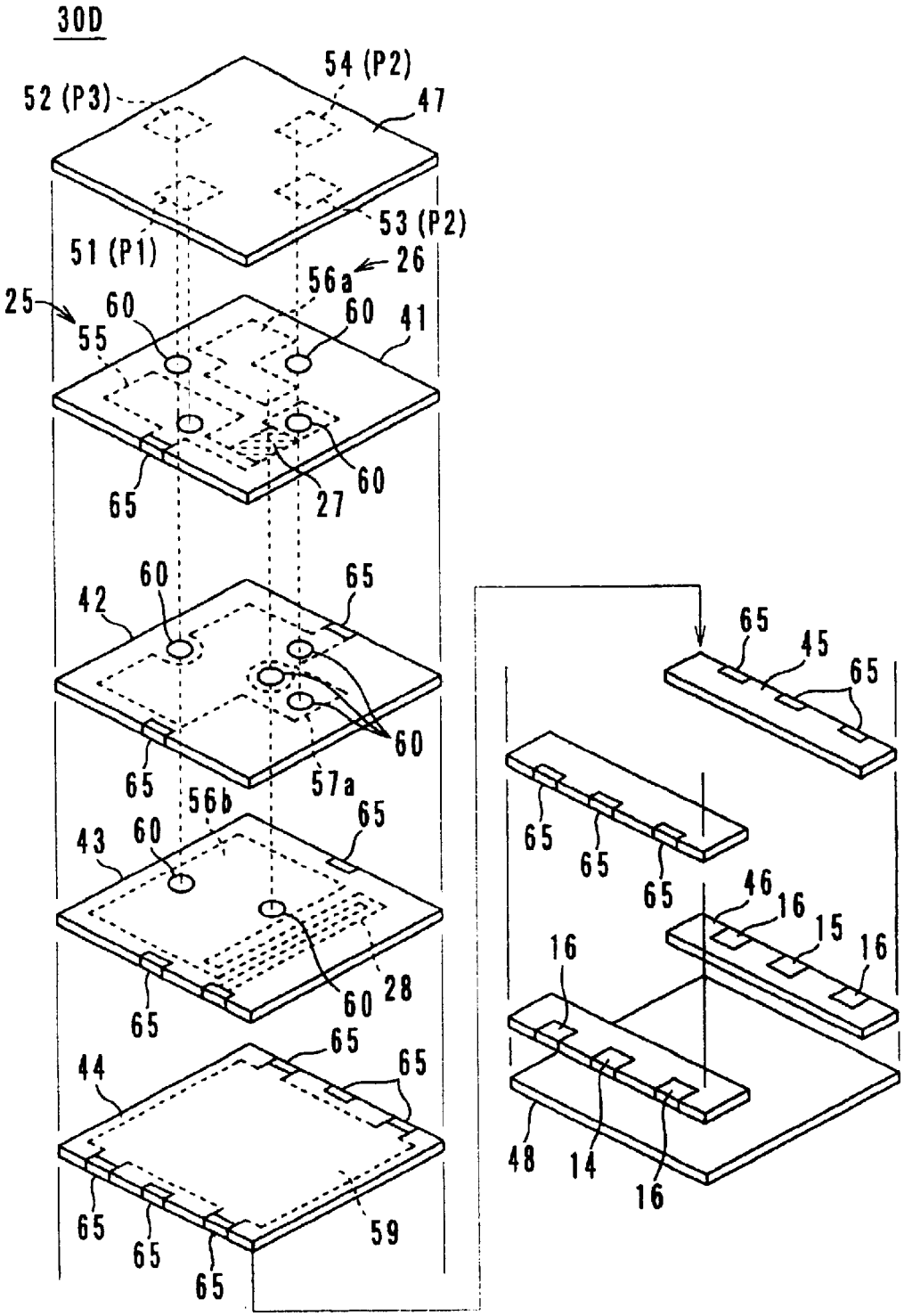
FIG. 19 is an exploded perspective view showing a modification of the multilayer substrate shown in FIG. 12.

The multilayer substrate 30C can be modified in various ways. For example, a multilayer substrate 30D shown in FIG. 19 includes the connection electrodes 51 to 54 for the center electrodes, a dielectric sheet 41 having the capacitor electrodes 55 and 56*a* and the resistor 27 on the back surface thereof, a dielectric sheet 42 having the capacitor electrodes 57*a* on the back surface thereof, a dielectric sheet 43 having the capacitor electrode 56*b* and the inductor electrode 28 on the back surface thereof, and a dielectric sheet 44 having the ground electrode 59 on the back surface thereof, dielectric sheets 46 having the input outer electrode 14, the output outer electrode 15, and the ground electrodes 16. The connection electrode 51 for the center electrode functions as the input port P1, the connection electrodes 53 and 54 for the center electrodes function as the output ports P2, and the connection electrode 52 for the center electrode functions as the third port P3.

The capacitor electrode 55, the capacitor electrode 57*a*, the left half of which is substantially opposed to the capacitor electrode 55, and the dielectric sheet 42 sandwiched between the capacitor electrodes 55 and 57*a* define a first matching capacitor 25. The capacitor electrodes 56*a* and 56*b*, the capacitor electrode 57*a* that is opposed to the capacitor electrodes 56*a* and 56*b*, the dielectric sheet 42 sandwiched between the capacitor electrodes 56*a* and 57*a*, and the dielectric sheet 43 sandwiched between the capacitor electrodes 57*a* and 56*b* define a second matching capacitor 26. The matching capacitors 25 and 26, the resistor 27, and the inductor 28 define an electrical circuit inside the multilayer substrate 30D, along with the electrodes 51 to 54, the outer electrodes 14 to 16, and the via holes 60 and 65.

A communication device according to a third preferred embodiment of the present invention will now be described in the context of a mobile phone.

Figure 20:
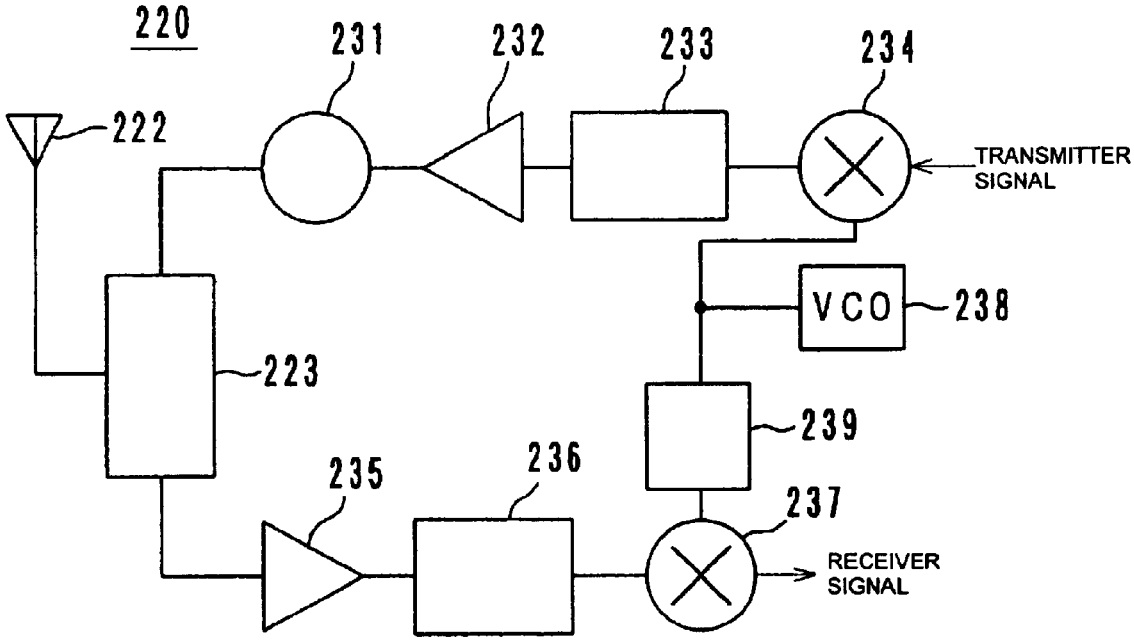
FIG. 20 is a block diagram of an electrical circuit in a communication device of the present invention.

FIG. 20 is a block diagram of a portion relating to radio frequencies used in a mobile phone 220. Referring to FIG. 20, reference numeral 222 is an antenna element, reference numeral 223 is a duplexer, reference numeral 231 is a transmitter isolator, reference numeral 232 is a transmitter amplifier, reference numeral 233 is a transmitter interstage bandpass filter, reference numeral 234 is a transmitter mixer, reference numeral 235 is a receiver amplifier, reference numeral 236 is a receiver interstage bandpass filter, reference numeral 237 is a receiver mixer, reference numeral 238 is a voltage controlled oscillator (VCO), and reference numeral 239 is a local bandpass filter.

The two-port isolator 1 of the first preferred embodiment or the two-port isolator 1C of the second preferred embodiment can be used as the transmitter isolator 231. Mounting such an isolator realizes a mobile phone having improved frequency characteristics and higher reliability.

The present invention is not limited to the embodiments described above. Many modifications can be made within the spirit and scope of the invention. For example, inverting the north pole and the south pole of the permanent magnet 9 switches the input port P1 and the output port P2. Although the multilayer substrate includes the inductor 28 in the preferred embodiments described above, the inductor 28 may be a chip inductor or an air-core coil. Also, the matching capacitors 25 and 26 may be single-plate capacitors.

As described above, according to the present invention, connecting an inductor in series to a second matching capacitor between a second input-output port and the ground or connecting the inductor between a third port and the ground provides in a trap circuit. Because the trap circuit produces an attenuation pole, the second harmonic wave (2*f*) and the third harmonic wave (3*f*) that is propagated through a first center electrode can be attenuated. As a result, a compact two-port isolator or communication device having higher performance and higher reliability can be provided.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed:

1. A two-port isolator comprising:

a permanent magnet;

a ferrite to which a DC magnetic field is applied by the permanent magnet;

a first center electrode disposed on the surface of the ferrite or inside the ferrite, one end of the first center electrode being electrically connected to a first input-output port and the other end of the first center electrode being electrically connected to a second input-output port;

a second center electrode disposed on the surface of the ferrite or inside the ferrite and intersects with the first center electrode in an electrically insulated state, one end of the second center electrode being electrically connected to the second input-output port and the other end of the second center electrode being electrically grounded;

a first matching capacitor electrically connected between the first input-output port and the second input-output port;

a resistor electrically connected between the first input-output port and the second input-output port; and a series resonant circuit, including a second matching capacitor and an inductor, electrically connected between the second input-output port and ground.

2. A two-port isolator according to claim 1, wherein a resonant frequency of the series resonant circuit including the second matching capacitor and the inductor is between the frequencies of the second and third harmonic waves.

3. A two-port isolator according to claim 1, wherein capacitor electrodes of the first matching capacitor and the second matching capacitor and an inductor electrode of the inductor are provided on a multilayer substrate including insulating layers.

4. A two-port isolator according to claim 1, wherein the two-port isolator is a lumped-constant isolator.

5. A two-port isolator according to claim 1, further comprising a metallic case including a metallic top case and a metallic bottom case having the permanent magnet, and the ferrite, the first and second center electrodes disposed therein.

6. A two-port isolator according to claim 1, wherein the ferrite is substantially circular and the first and second center electrodes are made of copper foil.

7. A two-port isolator according to claim 1, further comprising a multilayer substrate including the first and second matching capacitors, the resistor, and the inductor.

8. A two-port isolator according to claim 1, further comprising a multilayer substrate having the series resonant circuit disposed therein.

9. A two-port isolator according to claim 1, wherein the series resonant circuit functions as a trap circuit.

10. A two-port isolator according to claim 9, wherein the resonant frequency of the trap circuit is between the frequencies of the second and third harmonic waves.

11. A communication device comprising the two-port isolator according to claim 1.

12. A two-port isolator comprising:

a permanent magnet;

a ferrite to which a DC magnetic field is applied by the permanent magnet;

a first center electrode disposed on the surface of the ferrite or inside the ferrite, one end of the first center electrode being electrically connected to a first input-output port and the other end of the first center electrode being electrically connected to a second input-output port;

a second center electrode disposed on the surface of the ferrite or inside the ferrite and intersects with the first center electrode in an electrically insulated state, one end of the second center electrode being electrically connected to the second input-output port and the other end of the second center electrode being electrically connected to a third port;

a first matching capacitor electrically connected between the first input-output port and the second input-output port;

a resistor electrically connected between the first input-output port and the second input-output port;

a second matching capacitor electrically connected between the second input-output port and the third port; and an inductor electrically connected between the third port and the ground.

13. A two-port isolator according to claim 12, wherein the resonant frequency of a circuit that includes a parallel resonant circuit, including the second center electrode and the second matching capacitor, and the inductor is between the frequencies of the second and third harmonic waves.

14. A two-port isolator according to claim 12, wherein capacitor electrodes of the first matching capacitor and the second matching capacitor and an inductor electrode of the inductor are provided on a multilayer substrate including insulating layers.

15. A two-port isolator according to claim 12, wherein the two-port isolator is a lumped-constant isolator.

16. A two-port isolator according to claim 12, further comprising a metallic case including a metallic top case and a metallic bottom case having the permanent magnet, and the ferrite, the first and second center electrodes disposed therein.

17. A two-port isolator according to claim 12, further comprising a multilayer substrate including the first and second matching capacitors, the resistor, and the inductor.

18. A two-port isolator according to claim 13, further comprising a multilayer substrate having the parallel resonant circuit disposed therein.

19. A two-port isolator according to claim 13, wherein the parallel resonant circuit functions as a trap circuit.

20. A two-port isolator according to claim 19, wherein the resonant frequency of the trap circuit is between the frequencies of the second and third harmonic waves.

21. A communication device comprising the two-port isolator according to claim 12.

* * * * *